US007728242B2

(12) United States Patent
Huang

(10) Patent No.: US 7,728,242 B2
(45) Date of Patent: Jun. 1, 2010

(54) TRIGGER SWITCH

(75) Inventor: Fa-Sheng Huang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/233,844

(22) Filed: Sep. 19, 2008

(65) Prior Publication Data

US 2010/0025216 A1 Feb. 4, 2010

(30) Foreign Application Priority Data

Jul. 30, 2008 (CN) ..... 2008 1 0303230

(51) Int. Cl.
*H01H 13/02* (2006.01)

(52) U.S. Cl. ..... 200/341; 200/345; 335/205

(58) Field of Classification Search ..... 200/296, 200/318, 520, 318.1, 323–329, 341, 345; 341/22–25, 32; 345/168, 169; 335/205–207
See application file for complete search history.

(56) References Cited

U.S. PATENT DOCUMENTS 3,906,417 A * 9/1975 Serras-Paulet ..... 335/205
3,942,145 A * 3/1976 Sobczak ..... 335/188
4,342,975 A * 8/1982 Charpentier ..... 335/205
4,400,594 A * 8/1983 Serras-Paulet ..... 200/5 A
6,300,852 B1 * 10/2001 Kato ..... 335/170
6,392,515 B1 * 5/2002 Van Zeeland et al. ..... 335/205
6,677,843 B1 * 1/2004 Monroe et al. ..... 335/205
6,765,164 B2 * 7/2004 Lee et al. ..... 200/345
7,332,688 B2 * 2/2008 Browne et al. ..... 200/512
7,446,276 B2 * 11/2008 Plesko et al. ..... 200/343

* cited by examiner

*Primary Examiner*—Michael A Friedhofer
(74) *Attorney, Agent, or Firm*—Clifford O. Chi

(57) ABSTRACT

A trigger switch includes a first locating element, an elastic second locating element, and a pressing element slidably attached to the bezel. The pressing element is restricted by the first locating element to a first position of the bezel to prevent the trigger portion from contacting the trigger element. The second locating element restricts the pressing element to a second position of the bezel to further prevent the trigger portion from contacting the trigger element. The trigger portion contacts and applies a force to the trigger element to trigger the trigger element when the pressing element overcomes elastic forces of the second locating element.

11 Claims, 3 Drawing Sheets

TRIGGER SWITCH

BACKGROUND

1. Field of the Invention

The present invention relates to switches and, more particularly, to a trigger switch.

2. Description of Related Art

Trigger switches are typically used in electrical devices to turn on and power the devices. Typically, trigger switches protrude from or are flush with front bezels of electrical devices. As a result, the trigger switches may be easily pushed inadvertently. What is desired, therefore, is to provide a trigger switch for preventing unintentional triggering.

DETAILED DESCRIPTION OF THE EMBODIMENTS

Figure 1:
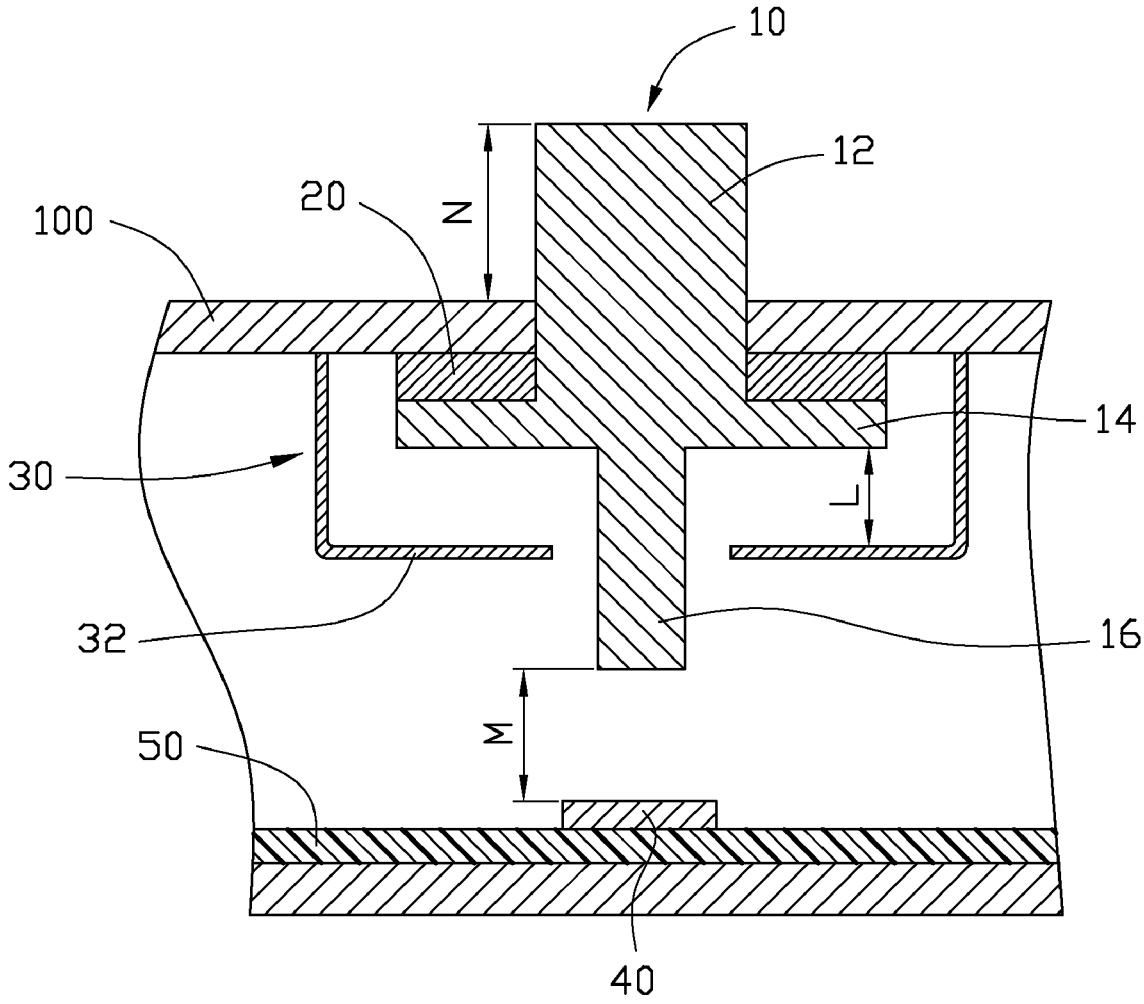
FIG. 1 is a sectional view of an embodiment of a trigger switch.

Referring to FIG. 1, an embodiment of a trigger switch includes a pressing element 10, a first locating element (not labeled), and a second locating element (not labeled).

The pressing element 10 includes a cylindrical pressing portion 12 having a first end and a second end, two rectangular attracting portions 14 extending perpendicularly from opposite sides of the second end of the pressing portion 12, and a cylindrical trigger portion 16 extending from the second end of the pressing portion 12.

The first locating element includes two magnets 20 positioned on an inner surface of a bezel 100 of an electrical device and located at opposite sides of a through hole defined in the bezel 100.

In the illustrated embodiment, the second locating element includes two L-shaped elastic members 30. Each elastic member 30 includes a fixing part (not labeled) fixed to the inner surface of the bezel 100 and a flexible part 32 extending perpendicularly from an end of the fixing part.

The first end of the pressing portion 12 passes through the magnets 20 and the through hole of the bezel 100, to extend out from the bezel 100. The attracting portions 14 of the pressing element 10 are attracted by and engage with the magnets 20. The attracting portions each have a magnet contacting surface configured to contact the magnets and an opposite switch facing surface. A distal end of the trigger portion 16 faces a trigger element 40 of a circuit board 50 of the electrical device. When the pressing element 10 is fully depressed, the distal end of the trigger portion 16 contacts and applies a force to the trigger element 40, and a switching circuit connected to the trigger element 40 is triggered. The flexible part 32 of each elastic member 30 is positioned opposite a corresponding magnet 20 and facing a corresponding attracting portion 14.

In an initial state, when the pressing element 10 is not depressed, a distance between the first end of the pressing portion 12 and the outer surface of the bezel 100 is "N". A distance between the flexible part 32 of each elastic member 30 and each of the switch facing surfaces is "L". A distance between the distal end of the trigger portion 16 and the trigger element 40 is "M". The distances M, L, and N satisfy the following formula: $L \leqq M \leqq N$.

Figure 2:
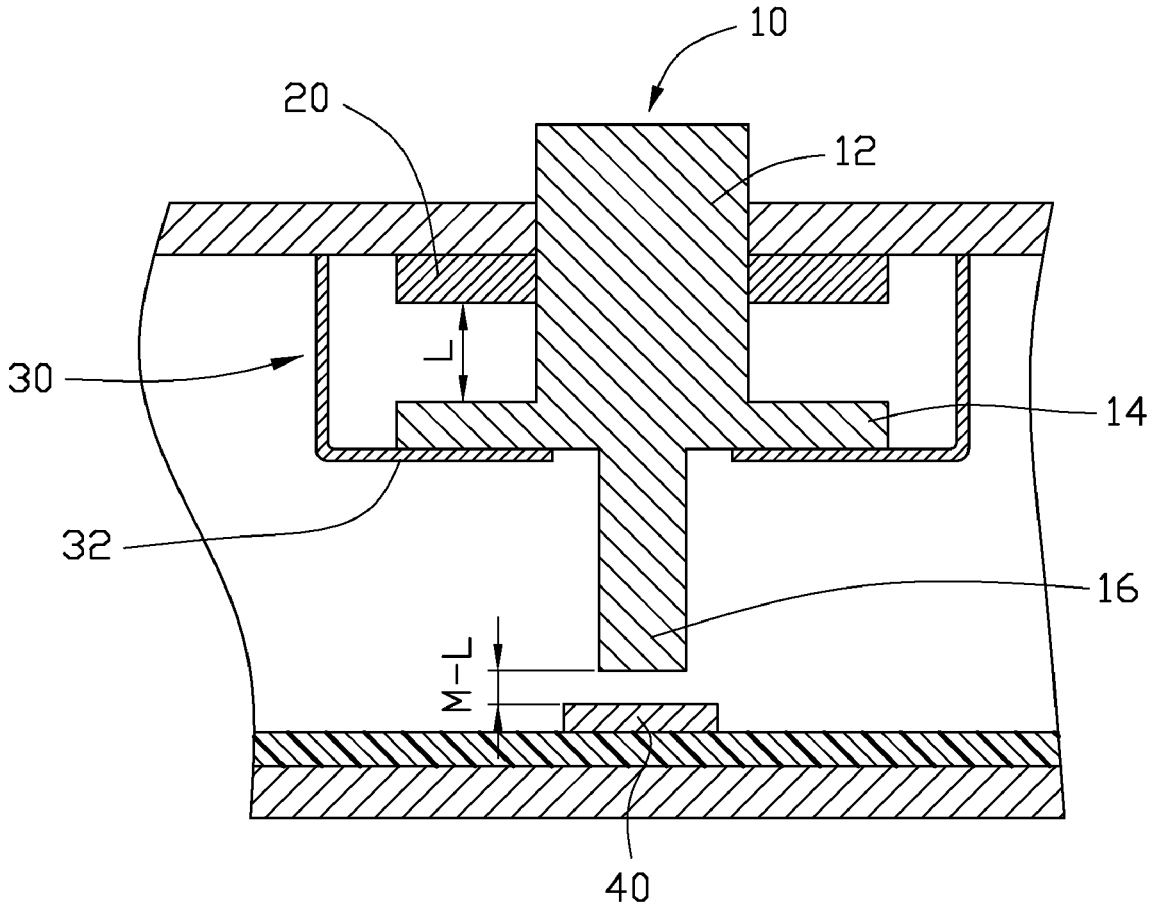
FIG. 2 is a sectional view of the trigger switch of FIG. 1, shown with the trigger switch gently depressed.

FIG. 2 shows the pressing portion 12 of the pressing element 10 unintentionally, but gently pressed. Although the pressing element 10 may overcome magnetic forces of the magnets 20 to move toward the trigger element 40, the attracting portions 14 must also overcome the flexible parts 32 of the elastic members 30. The elastic members 30 are sufficiently stiff to prevent the pressing element 10 from contacting the trigger switch. At this instance, a distance between the distal end of the trigger portion 16 and the trigger element 40 is equal to $M \leqq L$. Because $L \leqq M$, the trigger portion 16 of the pressing element 10 will not apply a force to the trigger element 40 and the switching circuit is not inadvertently triggered.

Figure 3:
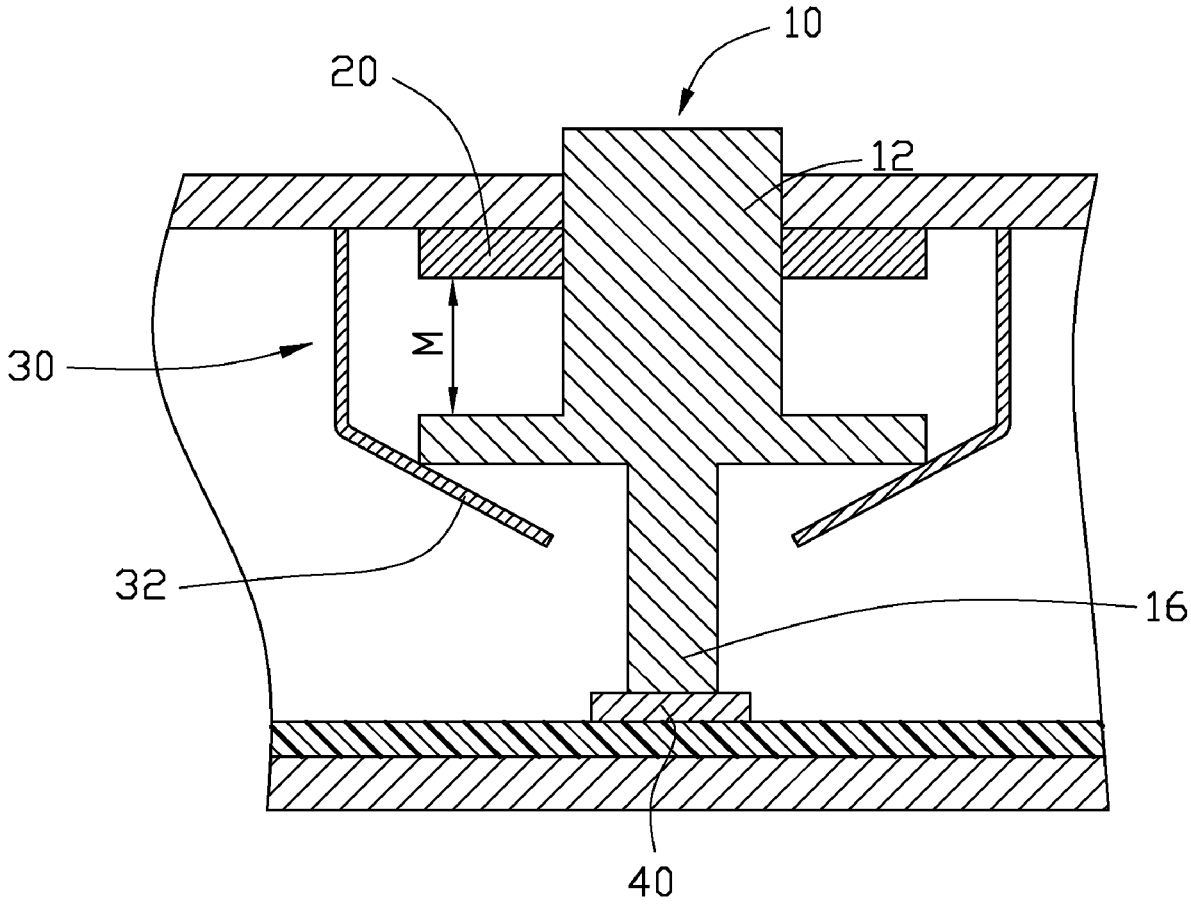
FIG. 3 is a sectional view of the trigger switch of FIG. 1, shown with the trigger switch fully depressed.

FIG. 3 shows the pressing portion 12 of the pressing element 10 fully depressed with enough force to overcome the elastic forces of the elastic members 30 and allow the pressing element 10 to contact and apply a force on the trigger element 40. As a result, the trigger element 40 is triggered. The pressing portion 12 is then released, and the elastic members 30 and the magnets 20 bias the pressing element 10 to resume to the initial state.

In another embodiment, the second locating element 30 includes two springs (now shown) positioned on the circuit board 50 and located opposite the trigger element 40 to limit movement of the pressing element 10.

It is to be understood, however, that even though numerous characteristics and advantages of the disclosure have been set forth in the foregoing description, together with details of the structure and function of the embodiment, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A trigger switch set on a bezel of an electrical device to trigger a trigger element of the electrical device, comprising: a pressing element slidably attached to the bezel, and comprising a trigger portion;

a first locating element configured to restrict the pressing element to a first position to prevent the trigger portion from contacting the trigger element;

an elastic second locating element configured to restrict the pressing element to a second position to further prevent the trigger portion from contacting the trigger element;

wherein the trigger portion contacts and applies a force to the trigger element to trigger the trigger element when the pressing element overcomes elastic forces of the second locating element.

2. The trigger switch of claim 1, wherein the pressing element further comprises a pressing portion having a first end and second end, and comprising two attracting portions extending perpendicularly from opposite sides of the second end of the pressing portion; the trigger portion extends from the second end of the pressing portion; when the pressing element is positioned at the first position, the attracting portions are engaged with the first locating element.

3. The trigger switch of claim 2, wherein the first locating element comprises two magnets positioned on an inner surface of the bezel; the attracting portions are capable of being attracted by the magnets to engage with the magnets.

4. The trigger switch of claim 3, wherein the second locating element comprises two L-shaped elastic members, a first end of each member is fixed to the inner surface of the bezel and a second end of each member is positioned between the attracting portions and the trigger element.

5. The trigger switch of claim 3, wherein the second locating element comprises two springs positioned on the circuit board and located opposite the trigger element to limit movement of the pressing element.

6. The trigger switch of claim 2, wherein the first end of the pressing portion protrudes out of the bezel, opposite to the trigger element, to be operated.

7. An electronic device, comprising:

a bezel defining a through hole, and having an inner side and an outer side;

a circuit board opposite to the bezel and facing the inner side of the bezel;

a trigger element electrically mounted to the circuit board;

a pressing element having a first end and a second end, wherein the second end is facing the trigger element; the first end is passing through the through hole of the bezel to protrude out of the outer side of the bezel; the pressing element is capable of sliding along the through hole;

a first locating element configured to restrict the pressing element to a first position to prevent the second end of the pressing element from contacting the trigger element;

an elastic second locating element configured to restrict the pressing element to a second position to further prevent the second end of the pressing element from contacting the trigger element;

wherein the second end of the pressing element contacts and applies a force to the trigger element to trigger the trigger element when the pressing element overcomes elastic forces of the second locating element.

8. The electrical device of claim 7, wherein the pressing element further comprises a pressing portion having a first end and a second end, and comprising two attracting portions extending perpendicularly from opposite sides of the second end of the pressing portion; and a trigger portion extends from the second end of the pressing portion; when the pressing element is positioned at the first position, the attracting portions are engaged with the first locating element.

9. The electrical device of claim 8, wherein the first locating element comprises two magnets positioned on the inner side of the bezel; the attracting portions are capable of being attracted by the magnets to engage with the magnets.

10. The electrical device of claim 9, wherein the second locating element comprises two L-shaped elastic members, a first end of each member is fixed to the inner side of the bezel and a second end of each member is positioned between the attracting portions and the trigger element.

11. The electrical device of claim 9, wherein the second locating element comprises two springs positioned on the circuit board and located opposite the trigger element to limit movement of the pressing element.

* * * * *